US005706631A

United States Patent [19]

Conrad

[11] Patent Number: 5,706,631

[45] Date of Patent: Jan. 13, 1998

[54] METHOD AND DEVICE FOR PACKAGING A ROLL FORMED BY A WOUND WEB OF MATERIAL

[75] Inventor: Hans-Rolf Conrad, Dormagen, Germany

[73] Assignee: Voith Sulzer Finishing GmbH, Krefeld, Germany

[21] Appl. No.: 705,046

[22] Filed: Aug. 29, 1996

[30] Foreign Application Priority Data

Sep. 22, 1995 [DE] Germany ..... 195 35 189.4

[51] Int. Cl.[6] ..... B65B 11/00

[52] U.S. Cl. ..... 53/409; 53/410; 53/204; 53/216

[58] Field of Search ..... 53/409, 410, 204, 53/214, 216, 245, 287, 367, 415, 416, 128.1, 135.1; 206/410, 413, 414, 415, 416

[56] References Cited

U.S. PATENT DOCUMENTS

| | | | |
|---|---|---|---|
| 1,764,081 | 6/1930 | Jones et al. . | |
| 3,296,772 | 1/1967 | Barker | 53/216 |
| 3,633,335 | 1/1972 | Johnson | 53/380 |
| 4,485,612 | 12/1984 | Piesen et al. | 53/216 |
| 4,524,562 | 6/1985 | Yagi et al. | 53/409 |
| 4,534,151 | 8/1985 | Schneck et al. | 53/419 |
| 4,633,650 | 1/1987 | Sohlbery et al. | 53/415 |
| 4,683,706 | 8/1987 | Harper | 53/367 |
| 4,958,478 | 9/1990 | Hannen et al. | 53/415 |
| 5,265,399 | 11/1993 | Niskanen et al. | 52/214 |
| 5,366,085 | 11/1994 | Kewin | 206/413 |
| 5,392,585 | 2/1995 | Wall | 53/204 |

FOREIGN PATENT DOCUMENTS

| | | |
|---|---|---|
| 0 634 323 | 1/1995 | European Pat. Off. . |
| 1 272 810 | 7/1968 | Germany . |
| 38 03 874 | 6/1991 | Germany . |
| 42 02 916 | 8/1993 | Germany . |

*Primary Examiner*—John Sipos
*Assistant Examiner*—Ed Tolan
*Attorney, Agent, or Firm*—Darby & Darby

[57] ABSTRACT

A method and device for packaging a roll formed by a wound web of material. The roll has a first axial end and a second axial end. The method includes the steps of (1) wrapping the roll with a web of packaging material; (2) forming an axial projecting length at each axial end of the packaging material; (3) placing an end cover against each axial end of the roll at a predetermined angle with respect to the axial end of the roll; and (4) folding each axial projecting length in onto the respective axial end of the roll thereby causing each end cover to move into contact with the respective axial end of the roll. The device includes a winding device that has a dispenser for the web of packaging material, a roller drive and a folding device to fold an axial projecting length of a web of packaging material onto at least one of the axial ends of the roll. An end cover feed device is disposed adjacent to the at least one of the axial ends of the roll. The end cover feed device includes a slide surface that is inclined with respect to the axis of the roll. The slide surface has a distal end that is spaced by a predetermined distance from the at least one of the axial ends of the roll. A line extending from the distal end of the slide surface intersects an outer peripheral edge of the at least one of the axial ends of the roll.

20 Claims, 1 Drawing Sheet

METHOD AND DEVICE FOR PACKAGING A ROLL FORMED BY A WOUND WEB OF MATERIAL

BACKGROUND OF THE INVENTION

1. Field of the Invention

The present invention relates to a method and device for packaging a roll formed by a wound web of material where an end cover is placed against each axial end of the roll. The roll is wrapped with a web of packaging material, which forms an axial projecting length projecting beyond each of the axial ends of the roll. The axial projecting length is folded in onto the axial end of the roll. In addition, the present invention relates to a device that uses a winding device to package a roll formed by a wound web of material. The winding device includes a dispenser for the web of packaging material, a roller drive, and a folding device. The folding device folds the axial projecting length of the web of packaging material in onto the axial ends of the roll. The device also includes an end cover supply device.

2. Discussion of the Related Art

Methods and devices for packaging a roll of material, particularly for the packaging of large rolls of paper or similar items are known. The roll diameters are typically between 500 and 2,100 mm. The roll widths (i.e., the axial length of the roll) are typically between 500 and 3,800 mm.

German reference DE 38 03 874 C2 discloses a method and device where an end cover is placed against the axial ends of the roll. To maintain the position of the end cover, the end cover is nailed to a plug, which is introduced into a hollow axle of the roll. Once the end cover is fastened, the roll is sent to the winding station. Thus, it is necessary to center the end cover with respect to the roll, which requires a certain amount of effort. The use of plugs in the roll cores has been viewed with increasing criticism in recent times because it is very difficult to dispose of plugs of this type. Any reuse of the plugs is generally precluded because the plugs are damaged during packaging or removal of the plugs.

German reference DE 42 02 916 A1 discloses end covers that are provided with fold out brackets, which can be introduced into the hollow core of the roll. However, these special end covers are not available everywhere. Additionally, the end cover must be centered with respect to the roll.

SUMMARY OF THE INVENTION

The present invention simplifies the packaging of the roll. The end cover is first held at an angle with respect to the end of the roll, and is only brought into contact with the axial end when the projecting length of the packaging material is folded in against the axial end of the roll.

Thus, in accordance with the present invention, two steps in the process of packaging a roll are achieved at the same time, namely, the fastening of the end cover to the axial end of the roll and the folding of the axial projecting length of the web of packaging material in onto the axial end. Because the end cover initially does not have to lie flat against the axial end of the roll (the end cover, within certain limits, only needs to be held at an angle with respect to the axial end of the roll), it is possible to configure the alignment of the end cover with respect to the roll in a much simpler manner. Thus, the alignment of the end cover with respect to the roll end can be achieved quicker.

The end cover is typically formed of a flat material, such as cardboard, which is of a sufficient stiffness. Thus, when the axial projecting length is folded in against the end cover and is pressed in the direction of the axial end of the roll, the end cover automatically lies against the axial end of the roll. Even if the end cover bends slightly, the method of the present invention can still be used because the end cover is gradually brought into position along its circumference against the axial end of the roll by the folding in of the projecting length along its circumference. Thus, once the axial projecting length of the web of packaging material has been folded in around the entire circumference of the roll, the end cover will also lie fully against the axial end of the roll. Frequently, after only an arc portion of the axial projecting length has been folded in over a portion of the circumference of the end of the roll, the end cover will lie against the axial end. For example, only 60° to 120° of the projecting length needs to be folded before the end cover will lie against the axial end of the roll. The alignment of the end cover with respect to the axial end roll is only necessary to ensure that the axial projecting length of the web of packaging material is taken hold of when the end cover is folded in. This type of an alignment can be achieved relatively easily. This is particularly true when the end cover is placed so that its edge is disposed in a gusset between the axial end of the roll and the projecting length of the packaging material. A gusset exists in this location because the axial end of the roll is disposed at a right angle with respect to the circumferential surface of the roll. The axial projecting length of the web of packaging material thus extends beyond the end of the roll at a right angle as well. As long as the projecting length has not been folded or pushed in, a gusset is formed between the axial end of the roll and the projecting length of the packaging material. This right angle then forms the gusset or open pocket into which the end cover can be inserted. If the axial projecting length in the region of this gusset is then folded in, the end cover will automatically be pressed against the axial end of the roll.

The gusset is preferably disposed in the lower portion of the roll. Thus, the force of gravity can be used to place the end cover into the gusset. As the end cover slides down a slide surface it practically slips into the gusset. Of course, when the end cover is placed into the gusset, the axial projecting length could be formed over the entire circumference of the roll. But it is also possible for the axial projecting length to exist only in the lower portion of the roll because it is only necessary in this area so that the end cover can be received in the gusset.

The folding in of the projecting length is preferably carried out at the lower portion of the roll. During the folding process, the end cover is pressed against the axial end of the roll due to the folding in of the axial projecting length immediately after insertion of the end cover. Thus, it is practically impossible for the end cover to slip out of position. However, the folding step does not have to take place at the exact lowest point of the roll because, for example, this is the point at which the roll usually lies on support or back-up rollers and there may not be enough space between the support rollers for a folding wheel. Therefore, the folding wheel may be placed adjacent to the support rollers or on one of the support rollers in the area of the lower portion of the roll.

The end cover is preferably moved into place against the axial end of the roll during the wrapping of the roll, which has a number of advantages. For example, the packaging time is reduced because the end cover is secured simultaneously with the folding in of the projecting length of the packaging material. Additionally, it is easier to fold in the axial projecting length of the web of packaging material in layers because the axial projecting length then provides only a small amount of resistance to the folding process.

The end cover is preferably moved to the axial end of the roll by a movement that is substantially carried out in the plane of the end cover. The end cover can thus slide all the way to the axial end of the roll. The end cover can more easily be shifted in its plane than in a direction perpendicular to its surface because, among other things, the cover provides less resistance to this type of movement as a result of a lower amount of air resistance. Thus, the handling of the end cover is easier. In addition, using a sliding movement ensures that there is less of a risk that the end cover will contact the axial projecting length of the packaging material during the sliding movement to the axial end of the roll and therefore damage the projecting length.

The end cover is preferably pivoted in the direction toward the axial end of the roll during or after the initial folding in of the projecting length. When the end covers are not very stiff, this additional contacting of the end cover by the projecting length improves the packaging of the roll because the end cover lies flatter against the end of the roll. Additionally, the wrapping of the roll, or more specifically, the step of folding in the projecting length of the packaging material can proceed more rapidly because great care of the end cover no longer has to be taken.

The end cover preferably slides down a slide plate and comes into contact against the axial end of the roll. The slide plate is preferably pivoted from a position in which the plate lies at an angle with respect to the axis of the roll to a position in which the plate is substantially parallel to the axis of the roll. However, the slide plate is pivoted so that it is not exactly parallel to the axial end of the roll. If the slide plate was pivoted to an exact parallel position, specific care would have to be taken to ensure that the axial projecting length of the web of packaging material, which may not have been completely folded in, was not damaged by the sliding plate. Additionally, the slide plate is pivoted in a direction away from the folding device and this pivoting movement causes the end cover to move against the axial end of the roll. This pivoting of the end cover (due to the pivoting movement of the sliding plate) in combination with the pressing of the end cover against the axial end of the roll (due to the folding in of the axial projecting length of the web of packaging material) has proven to be a simplified manner to package a roll.

In a preferred embodiment, the end cover feed device includes a slide plate, which has an upper slide surface that is inclined with respect to the axis of the roll. The slide surface has a distal end that is spaced by a predetermined distance from the end of ate roll. A line extending from a distal end of the slide surface intersects an outer peripheral edge of the axial end of the roll. Thus, the end cover can easily be moved into the desired position (i.e., in an inclined position with respect to the axis of the roll) with no problem, without disturbing the folding in of the axial projecting length and the pressing of the end cover against the axial end of the roll. The distal end of the slide surface is spaced from the axial end of the roll so that adequate space is available for the folding in process. Because the slide surface is inclined so that an imaginary extension thereof intersects the outer edge of the axial end of the roll, an end cover which has sufficient stiffness will, even if it projects beyond the slide surface, contact against the axial end of the roll at its outer edge. The remaining portion of the end cover will continue to be supported by the slide surface so that the end cover is held in the inclined position with respect to the end of the roll. If the axial projecting length of the web of packaging material is folded in, the end cover will gradually be lifted from the slide surface and moved into position against the axial end of the roll.

The distance between the distal end of the slide surface and the axial end of the roll is preferably greater than the projecting length of the packaging material so that the slide surface and the axial projecting length will not interfere with each other.

The slide surface is preferably inclined downwardly toward the axial end of the roll, in the direction of the force of gravity. Thus, the end cover will slide into the desired position as a result of the force of gravity and an additional driving device is not necessary. However, an additional driving device can be used to speed up the movement of the end cover down the slide surface if desired.

The folding device is preferably disposed below the roll (i.e., in the direction of the force of gravity). The axial projecting length can then be folded in immediately after the end cover has moved into contact against the axial end of the roll. Thus, the end cover is practically never in the region of the axial end of the roll in a uncontrolled manner (i.e., in an inclined position as illustrated in FIG. 1).

It is to understood that the term "downward" or "lower portion" does not have to mean the lowest point of the roll. For example, the folding device may be placed in the vicinity of the support or back-up rolls or on a support or back-up roll.

A conveying device is connected to a proximal end of the slide surface. The proximal end faces away from the axial end of the roll. Thus, the end cover does not have to be placed directly on the slide surface if, for example, it is being moved from a magazine to the slide surface. The end cover can be placed on the conveying device, which thereby permits one more degree of freedom for the gripping device, which can now move the end cover from the magazine to the conveying device.

The conveying device can be, for example, a conveyor belt. Thus, it is not critical, at least with respect to the direction of movement of the conveyor belt, where the end cover is placed on the conveying device by the gripper. Generally, the conveyor belt will move in the axial direction of the roll.

The slide surface is preferably placed on a carriage, which can move in the axial direction. Thus, the position of the end cover feed device can be adjusted to accommodate for rolls having different axial lengths. Thus, in every case, the end cover will slide into the correct position against the axial end of the roll.

The angle of inclination of the slide surface can be adjusted, which has at least two advantages. First, the "target accuracy" can be improved. In other words, even if the carriage can only travel to a limited extent, by adjusting the angle of inclination of the slide surface one can assure that the end cover will always slide into the correct position at the outer peripheral edge of the axial end of the roll. Second, this selectively adjustable inclination of the slide surface can be used to press the end cover against the axial end of the roll. More specifically, the front (or distal) end of the slide surface (i.e., the end of the slide surface facing the end of the roll) is used to pivot the end cover against the axial end of the roll. The full positioning of the end cover does not have to be brought about by the front end of the slide surface. The end cover is only pressed further in the direction of the axial end of the roll to simplify the complete positioning of the end cover by the folding in of the axial projecting length of the web of packaging material.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
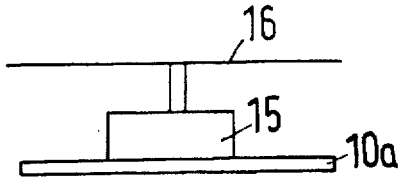
FIG. 1 is a schematic side view of a device for packaging a roll of material according to the present invention.
Figure 1:
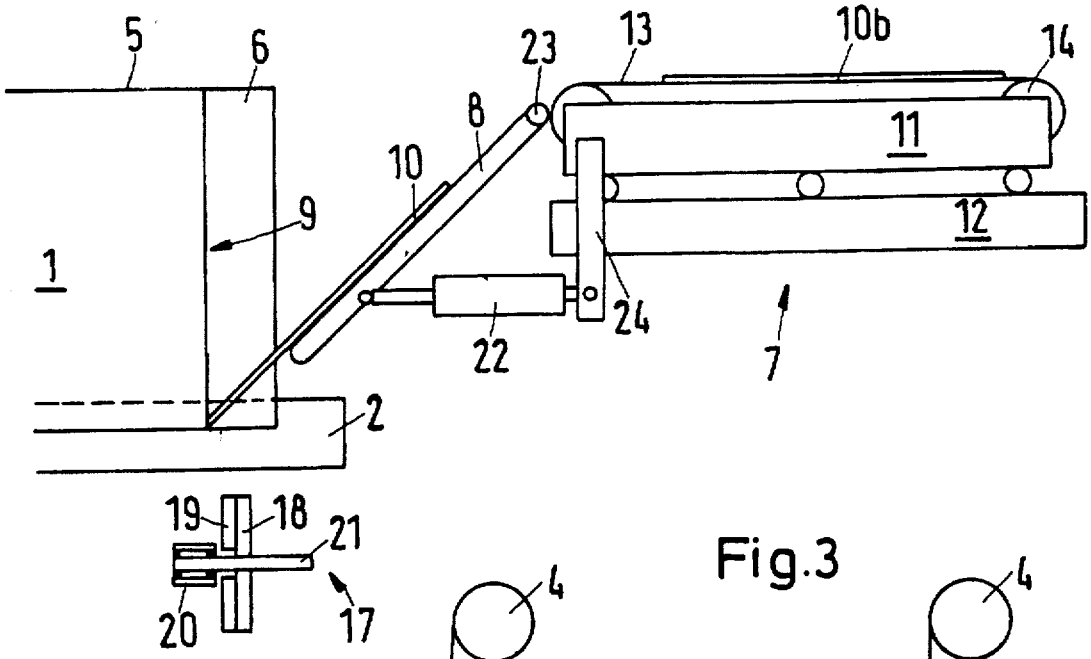
Figure 2:
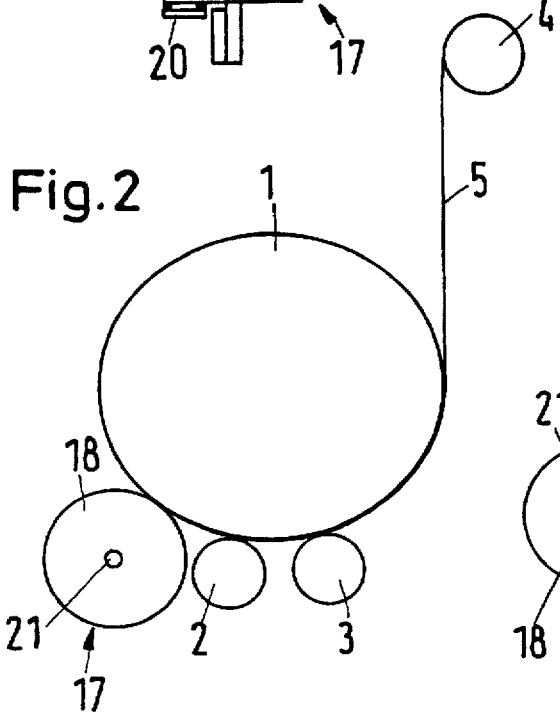
FIG. 2 is a schematic end view of a partially wrapped roll.
Figure 3:
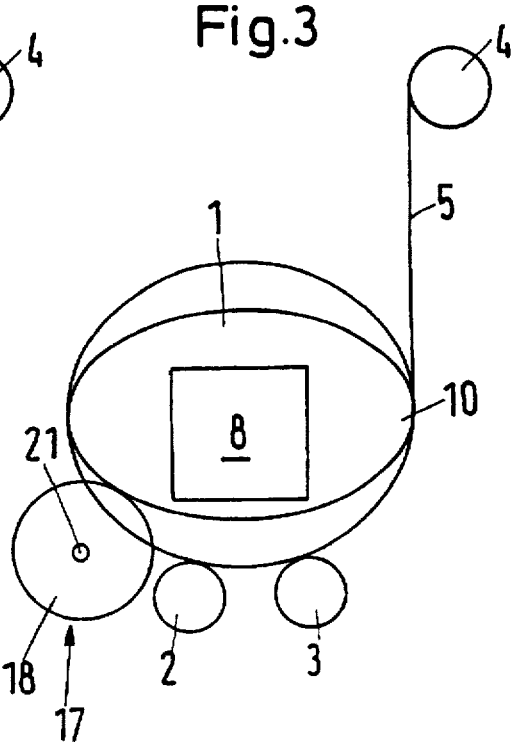
FIG. 3 is a schematic end view corresponding similar to FIG. 2, with the end cover placed on the axial end of the roll.

Referring now to FIGS. 1–3, a device for packaging a roll of material 1 is illustrated. Roll 1 is supported by two support rollers 2, 3. At least one of the support rollers is rotatably driven about its longitudinal axis to rotatably drive roll 1 about its longitudinal axis. A web of packaging material 5 is drawn from a supply roll 4 and is directed around roll 1. The web of packaging material 5 projects axially beyond the axial ends of the roll 1, thereby forming an axial projecting length 6 at each axial end of the roll. Typically, the projecting length is from 100 to 150 mm long.

An end cover feed device 7 is disposed at both axial ends 9 of the roll 1. For the sake of clarity in the drawings, only one feed device 7 is illustrated. It is to be understood that the non-illustrated feed device that is disposed adjacent to the opposite axial end of the roll is identical to the one illustrated in FIG. 1, but is a mirror image thereof.

The end-cover feed device 7 has a sliding plate, which has an upper slide surface 8. A distal end of the upper slide surface 8 is disposed outside of (i.e., exterior to) the projecting length 6 of the packaging material. The sliding surface 8 is directed diagonally downwardly toward the axial end of the roll so that the plane of the surface forms an angle of approximately 45° with the longitudinal axis of roll 1. Slide surface 8 is aligned so that an imaginary line extending from the surface towards the roll intersects with the outer peripheral edge of the axial end 9 of the roll. An end cover 10, which slides down the slide surface 8, slips automatically into a gusset disposed between the end 9 of the roll 1 and the axial projecting length 6 of the web of packaging material 5.

To accommodate for rolls that have different axial lengths, the slide surface 8 is disposed on a carriage 11, which can be moved in the axial direction on a track 12. A conveyor belt 13, which is driven by a deflection roller 14, is also disposed on carriage 11. A gripper 15 is suspended above the conveyor belt 13 from a transport track 16. Gripper 15 grabs an end cover 10*a* from a magazine (not shown) and places the end cover on the conveyor belt 13 at the position illustrated by end cover 10*b*. When conveyor belt 13 is moved in the direction toward the slide surface 8, end cover 10 is transferred onto the slide surface 8. End cover 10 slides down the slide surface into the gusset between the axial projecting length 6 and the axial end 9 of the roll 1.

End cover 10 has a predetermined stiffness so that it will remain substantially flat, even after the distal end of the cover is cantilevered beyond the distal end of the slide surface 8. It is to be noted, however, that a slight bending of the end cover 10 will not be detrimental to the operation of the packaging device.

A folding device 17 is disposed adjacent to the support rolls 2, 3. Folding device 17 includes a folding wheel 18, pressing blades 19 and a pressing roll 20, which are all mounted on an axle 21. Axle 21 is preferably rotatably driven about its longitudinal axis. Alternatively, the folding device 17 can be placed on support roll 2 in such a way theft device 17 cannot rotate, but can be moved axially.

In operation, folding device 17 is moved from a rest position (shown in FIG. 2) to a working position where device 17 is disposed next to support roll 2. Device 17 moves the portion of the axial projecting length 6 disposed in the lower region of the roll 1 to a position adjacent the axial end 9 of the roll 1. FIG. 3 shows the folding device 17 at an intermediate position between the rest position and the working position and on the way to the working position.

As a result of the action of the folding device 17, while the folding device is moving radially inwardly, the support rollers 2, 3 cause the roll 1, including packaging material 5 and projecting length 6, to rotate about its longitudinal axis. The folding in of the projecting length 6 causes the end cover 10 to be folded in against the axial end 9 of the roll 1. The end cover 10 is folded in during or after the initial folding in of the projecting length. In other words, initially the projecting length 6 may be folded in without initially moving the end cover 10. After the folding has proceeded for a period of time, the projecting length 6 will contact the end cover 10, thereby causing the end cover 10 to be folded in against the axial end 9 of the roll. Even if the inherent stiffness of the end cover 10 is not adequate to place the end cover 10 completely against the axial end 9 of the roll right at the start of the folding in of the projecting length 6, the complete placement of the end cover 10 against the end 9 will be achieved after a certain amount of time. Due to the rotation of roll 1, the folding device 17 eventually acts upon the projecting length 6 over the entire circumference of the end cover 10, and thus eventually places the end cover 10 against the axial end 9 of the roll 1. In most cases, however, it will be seen that as a result of the stiffness of the end cover 10, a complete positioning of the end cover 10 against the axial end 9 of the roll 1 is achieved after only a relatively small amount of the folding has taken place. The folding of the projecting length 6 of the web of packaging material 5 in onto the end 9 of the roll 1 is sufficient to hold the end cover 10 against the axial end 9, without requiring the need for any additional measures, such as, for example, nails, to hold the end cover 10 against the axial end 9.

To alleviate the positioning of the end cover 10 against the axial end 9, the slide surface 8 can be lifted, (i.e., the slide surface can pivot in a clockwise direction as illustrated in FIG. 1 about joint 23) with the aid of a pneumatic or hydraulic cylinder 22. Slide surface 8 is pivotally connected to the carriage 11 by means of a pivot joint 23 so that surface 8 can carry out this pivoting movement. Cylinder 22 is preferably fastened in an articulated manner to an extension arm 24 that is fixedly connected to the carriage. When slide surface 8 is lifted it moves from an inclined position illustrated in FIG. 1 into a position in which the slide surface 8 forms a smaller angle with respect to the axis of the roll 1. Because slide surface 8 is not moved to a position where it is parallel to the axis of the roll 1, there is no danger of surface 8 colliding with the axial projecting length 6 of the web of packaging material 5. The stiffness of the end cover 10 is used to achieve a rapid positioning of the end cover 10 against the axial end 9 of the roll.

As can be seen from FIG. 2, the end cover 10 can be inserted as early as when the web of packaging material 5 has wound around the lowest point of the roll 1 because the end cover 10 will be supported from below by the projecting length 6. By rotating the roll in a clockwise direction as viewed in FIG. 2, the end cover 10 is completed supported to the left and right of the lowest point of the roll as well. If the folding device 17 is operated at this position, it only has to fold single layers of the web of packaging material 5 although the axial end 9 of the roll 1 at one time, which makes the folding easier. However, it is also possible to place the end cover against the roll 1 after the projecting length 6 has formed multiple layers. In any case, the end cover 10 is the wrapping of the roll 1 with the web of packaging material 5 or, at the latest, when the projecting length 6 is folded in onto the end 9 of the roll.

In a conventional manner, an outer end cover (not shown) can also be moved into position against the end cover 10 after the folding of the axial projecting length 6 in onto the end cover. This outer end cover then provides the final closing for the packaging of the roll.

Having described the presently preferred exemplary embodiment of method and device for the packaging of a roll formed by a wound web of material in accordance with the present invention, it is believed that other modifications, variations and changes will be suggested to those skilled in the art in view of the teachings set forth herein. For example, the slide surface 8 can be provided with a transport device, such as a small conveyor belt, to speed up the transfer of the end cover 10 towards the roll 1. It is, therefore, to be understood that all such modifications, variations, and changes are believed to fall within the scope of the present invention as defined by the appended claims.

What is claimed is:

1. A method for packaging a roll formed by a wound web of material, said roll having a first axial end a second axial end, said method comprising the steps of:

wrapping the roll with a web of packaging material;

forming an axial projecting length at each axial end of the packing material;

placing an end cover against each axial end of the roll at a predetermined inclined angled with respect to the axial end of the roll; and folding each axial projecting length in onto the respective axial end of the roll thereby causing each end cover progressively to move into contact with respective axial end of the roll.

2. The method according to claim 1, wherein the end cover is placed against each axial end so that its edge is placed in a gusset disposed between the axial end of the roll and the projecting length of the packaging material.

3. The method according to claim 2, wherein the gusset is formed in a lower portion of the roll and the projecting length.

4. The method according to claim 3, wherein the folding step is carried out from below the roll.

5. The method according to claim 1, wherein the end cover is moved into contact against the respective axial end of the roll substantially simultaneously with the wrapping step.

6. The method according to claim 1, further comprising the step of moving the end cover into contact against the respective axial end of the roll with a device that moves the end cover in a direction that is substantially the same as the plane of the end cover.

7. The method according to claim 1, further comprising the step of pivoting the end cover toward the axial end of the roll substantially simultaneously with the folding step.

8. The method according to claim 7, wherein the end cover is pivoted by a sliding plate, the end cover slides down the slide plate against the axial end of the roll, the slide plate is pivoted from a position in which the slide plate is disposed at a predetermined angle with respect to the axis of the roll into a position in which the slide plate is disposed substantially parallel with respect to the axis of the roll.

9. The method according to claim 1, further comprising the step of pivoting the end cover toward the axial end of the roll after the folding step.

10. The method according to claim 9, wherein the end cover is pivoted by a sliding plate, the end cover slides down the slide plate against the axial end of the roll, the slide plate is pivoted from a position in which the slide plate is disposed at a predetermined angle with respect to the axis of the roll into a position in which the slide plate is disposed substantially parallel with respect to the axis of the roll.

11. A device for packing a roll formed by a wound web of material, said roll having a first axial end and a second axial end, said device comprising:

a winding device and a roller device having a dispenser for the web of packaging material to wind said material around said roll and to form an axial projecting length of the web of packaging material onto at least one of the said axial ends of said roll;

an end cover;

an end cover feed device disposed adjacent to said at least one of said axial ends of said roll, said end cover feed device including a slide surface for slidably receiving said end cover, said slide surface being inclined with respect to the axis of said roll, said slide surface having a distal end that is spaced by a predetermined distance from said at least one of said axial ends of said roll, wherein a line, which constitutes an extension of the sliding surface, extending from the distal end of said slide surface intersects an outer peripheral edge of said at least one of said axial ends of said roll;

a folding device for folding said axial projecting length and for progressively raising said inclined end cover against the axial end of the roll.

12. The device according to claim 11, wherein said predetermined distance is greater than said projecting length.

13. The device according to claim 11, wherein said slide surface is inclined downwardly toward said at least one of said axial ends of said roll.

14. The device according to claim 11, wherein said folding device is disposed below said roll.

15. The device according to claim 11, wherein said end cover feed device includes a conveying device connected to a proximal end of said slide surface, said proximal end facing away from said at least one of said axial ends of said roll.

16. The device according to claim 15, wherein said conveying device is a conveyor belt.

17. The device according to claim 11, wherein said slide surface is disposed on a carriage and said carriage is axially movable.

18. The device according to claim 11, wherein the angle of inclination of said slide surface is adjustable.

19. A method for packaging a roll formed by a wound web of material, said roll having a first axial end and a second axial end, said method comprising the steps of:

wrapping the roll with a web of packaging material;

forming an axial projecting length at each axial end of the packaging material;

placing an end cover against each axial end of the roll at a predetermined angle with respect to the axial end of the roll;

folding each axial projecting length in onto the respective axial end of the roll thereby causing each end cover progressively to move into contact with the respective axial end of the roll; and pivoting the end cover toward the axial end of the roll substantially simultaneously with the folding step, wherein the end cover is pivoted by a sliding plate, the end cover slides down the slide plate against the axial end of the roll, the slide plate is pivoted from a position in which the slide plate is disposed at a predetermined angle with respect to the axis of the roll into a position in which the slide plate is disposed substantially parallel with respect to the axis of the roll.

20. A method for packaging a roll formed by a wound web of material, said roll having a first axial end and a second axial end, said method comprising the steps of:

wrapping the roll with a web of packaging material;

forming an axial projecting length at each axial end of the packaging material;

placing an end cover against each axial end of the roll at a predetermined angle with respect to the axial end of the roll;

folding each axial projecting length in onto the respective axial end of the roll thereby causing each end cover to move into contact with the respective axial end of the roll; and pivoting the end cover toward the axial end of the roll after the folding step, wherein the end cover is pivoted by a sliding plate, the end cover slides down the slide plate against the axial end of the roll, the slide plate is pivoted from a position in which the slide plate is disposed at a predetermined angle with respect to the axis of the roll into a position in which the slide plate is disposed substantially parallel with respect to the axis of the roll.

* * * * *